United States Patent [19]

Ogden

[11] Patent Number: 4,925,724

[45] Date of Patent: May 15, 1990

[54] SLIP-RESISTANT, CUSHIONING MATERIAL

[75] Inventor: John M. Ogden, Cincinnati, Ohio

[73] Assignee: Ogden Inc., Cincinnati, Ohio

[21] Appl. No.: 294,173

[22] Filed: Jan. 6, 1989

Related U.S. Application Data

[63] Continuation-in-part of Ser. No. 142,474, Jan. 11, 1988.

[51] Int. Cl.[5] ..... B32B 3/10; A43B 13/38

[52] U.S. Cl. ..... 428/137; 428/138; 36/44; 12/146 B

[58] Field of Search ..... 36/44, 43, 3 R, 3 B; 12/146 B, 146 BR; 128/588, 594; 428/138, 137

[56] References Cited

U.S. PATENT DOCUMENTS

| | | | |
|---|---|---|---|
| 354,693 | 12/1886 | Dick | 36/3 B |
| 1,106,986 | 8/1914 | Stucki . | |
| 1,994,681 | 3/1935 | Blumenfeld | 36/3 B |
| 2,300,681 | 11/1942 | Margolin . | |
| 2,432,533 | 12/1947 | Margolin | 36/3 B |
| 2,722,063 | 11/1955 | Drefvelin | 36/3 R |
| 2,748,502 | 6/1956 | Scholl | 36/44 |
| 3,383,782 | 5/1968 | McGinnity . | |
| 3,449,844 | 6/1969 | Spence | 36/44 |
| 3,530,489 | 9/1970 | Appleton | 36/44 |
| 3,555,709 | 1/1971 | Raffaelli, Sr. | 36/44 |
| 3,724,105 | 4/1973 | Weight | 36/44 |
| 4,054,706 | 10/1977 | Shapiro | 36/44 X |
| 4,099,342 | 7/1978 | Singh | 36/44 |
| 4,179,826 | 12/1979 | Davidson . | |
| 4,187,621 | 2/1980 | Cohen | 36/44 |
| 4,223,458 | 9/1980 | Kihara | 36/44 |
| 4,237,626 | 12/1980 | Brown . | |
| 4,263,727 | 4/1981 | Bender et al. | 36/44 |
| 4,316,926 | 2/1982 | Kaminstein | 428/138 X |
| 4,361,614 | 11/1982 | Moffitt, Jr. | 428/138 |
| 4,430,811 | 2/1984 | Okada | 36/44 X |
| 4,471,538 | 9/1984 | Pomeranz et al. . | |
| 4,627,178 | 12/1986 | Sullivan et al. | 36/44 |
| 4,627,179 | 12/1986 | McElrot | 36/44 |
| 4,635,385 | 1/1987 | Ogden | 36/43 |
| 4,642,912 | 2/1987 | Wildman et al. | 36/44 |
| 4,709,490 | 12/1987 | Föttinger et al. | 36/44 |
| 4,789,578 | 12/1988 | Twyford et al. | 438/138 X |

FOREIGN PATENT DOCUMENTS

| | | | |
|---|---|---|---|
| 1026299 | 2/1953 | France | 36/3 B |
| 69831 | 9/1958 | France | 36/3 B |
| 0501878 | 3/1939 | United Kingdom | 36/44 |
| 0728075 | of 1955 | United Kingdom | 36/44 |
| 2185213 | 7/1987 | United Kingdom | 428/138 |

*Primary Examiner*—James Kee Chi

*Attorney, Agent, or Firm*—Wood, Herron & Evans

[57] ABSTRACT

A sheet material comprising a cushioning layer formed of resilient, cushioning material, and a non-absorbent, thermally non-conductive top layer of thermoplastic material formed with apertures which is embedded into the cushioning layer so that the cushioning material extends at least partially into the apertures in the top layer. The coefficient of friction of the top layer of the sheet material can be varied to alter the degree of slip-resistance of the sheet material depending upon the requirements of a particular application. The cushioning material forming the cushioning layer may be moisture-absorbent to help channel away moisture from the top layer, and, in one embodiment, is affixed to a second cushioning layer to form a three-layer sheet material.

24 Claims, 2 Drawing Sheets

SLIP-RESISTANT, CUSHIONING MATERIAL

RELATED PATENTS

This is a continuation-in-part application of U.S. patent application Ser. No. 07/142,474, filed Jan. 11, 1988 and entitled "Shoe Insole and Method of Manufacture".

FIELD OF THE INVENTION

This invention relates generally to slip-resistant, sheet material, and, more particularly, to a material having a slip-resistant, apertured top layer embedded in a bottom layer having moisture-absorbent and/or cushioning properties.

BACKGROUND OF THE INVENTION

A large portion of the materials which we walk on, e.g., insoles of shoes, indoor carpeting, outdoor carpeting, floor mats, etc., have a basic construction which has remained essentially the same for a number of years. In most instances, such materials consist essentially of a top layer of fibrous cloth or fabric material which touches the foot, and a second layer of a backing material connected to the top layer which may or may not have cushioning properties. Despite improvements in certain aspects of these types of products such as wear life and comfort, little or no attention has been paid to their slip-resistance, moisture-absorbency or thermal conductivity characteristics.

For example, in the design of insoles for shoes, and particularly insoles for athletic shoes or other active wear shoes, an effort has been made to improve the resiliency of the insole so that the material returns to its original shape and thickness after repeated use. But certain aspects of insoles for active wear shoes have been overlooked, such as the configuration and surface characteristics of the insole of the shoe as they relate to the ability of the insole to maintain the foot and sock relatively dry and insulated from the sole of the shoe, and the extent which the foot and sock are permitted to move within the shoe.

Most insoles for active wear shoes are formed of a cushioning material such as rubber, foam or the like whose uppermost surface is covered by a sheet of cloth or leather which contacts the sock of the wearer's foot. One problem with this type of insole is that the rubber or foam absorbs moisture from the sock like a sponge and does not allow the sock to dry. The cloth or leather upper layer of some insoles are provided with tiny spaced perforations to help channel away the moisture from the sock, and to provide ventilation, but the moisture is absorbed by the insole and then flows back through the perforations to the sock. Ventilation openings are provided in the insole and/or fabric sides of the shoe in some designs to help channel away moisture from the insole, but most of the moisture is nevertheless permitted to collect and pool in the insole which prevents the sock from drying.

Another problem with prior art insoles for active wear shoes involves a failure to control the motion of the sock and foot of the wearer along the insole. This affects both the comfort and performance of the shoe. For example, certain activities such as the play of tennis on clay courts and soccer on grass result in substantial movement of the shoe with respect to the playing surface. In these types of activities, it is desirable to limit the movement of the foot and sock with respect to the insole of the shoe for added comfort and to optimize the performance of the shoe. On the other hand, comfort and performance of the shoe dictate that the foot and sock be permitted more movement within shoes intended for use in activities such as basketball, racquetball and aerobics which are typically played on a lacquered hardwood floor wherein limited movement of the shoe relative to the playing surface is permitted.

Prior art insoles can generally be divided into two categories, both of which fail to take into account the movement of the foot and sock within the shoe and the type of surface on which the shoe is utilized. In some prior art designs, the top surface of the insole is formed of a tacky or sticky material having a high slip-resistance or coefficient of friction compared to a coefficient of friction of the skin of the foot. Active wear shoes with this type of insole have been found to create blisters on the foot because during use the sock is held in a fixed position against the insole while the foot moves within the sock. The rubbing motion of the foot within the sock creates severe blistering and discomfort, particularly in activities such as basketball and the like played on hardwood floors which permit limited motion of the shoe therealong.

The other general category of insole designs comprises a rubber or foam bottom layer which is covered by an overlayer of cloth or leather having a relatively slippery or slick surface with a much lower slip-resistance or coefficient of friction compared to that of the skin of the wearer's foot. Insoles of this type help avoid the blistering problem because the foot and sock move as a unit relative to the slippery top layer of the insole, instead of the foot moving within the sock. The problem with these insoles is that movement of the sock and foot of the wearer is often completely unrestricted and the toes are permitted to violently slide into the front portion of the shoe causing bruising or even fractures of the toes. In addition, undue movement of the foot and sock gives the wearer a feeling of lack of control of the shoe, particularly in activities where the shoe readily slides along the playing surface.

Problems with moisture-absorbency, slip-resistance and thermal insulation are also prevalent in sheet-type products other than insoles, e.g., indoor-outdoor carpeting; floor coverings for boats, campers, swimming pool decks, etc.; floor mats, and other items. In many products of this type, the surface which is walked on has limited slip-resistance and can become particularly hazardous when wet. With respect to moisture absorbency, such products usually function like a sponge, i.e., they become saturated and fail to channel moisture away from the top surface of the carpet or other floor covering, thus causing the moisture to pool on the surface which contacts the foot or shoe. Additionally, sheet material used for floor coverings or the like often provides only limited thermal insulation to protect the feet from the heat or cold of a surface upon which the sheet material rests.

SUMMARY OF THE INVENTION

It is therefore among the objectives of this invention to provide a sheet material adapted for such uses as insoles for active wear shoes and various slip-resistant surface coverings, which provides a thermal barrier between the foot and the surface upon which the sheet material rests, which can be modified to provide different degrees of slip-resistance, which helps channel away moisture and which provides a shock absorbing, cushioning feel when walked upon.

These objectives are accomplished in a sheet material including a top layer formed of a nonabsorbent, thermally non-conductive thermoplastic material, and a cushioning layer formed of a resilient, cushioning material such as rubber or foamed plastic. The top layer is formed with a plurality of apertures oriented in columns and rows with thin beads or walls of thermoplastic material therebetween. The top layer is embedded into the cushioning layer so that a portion of the thickness of the walls of the top layer extends beneath the upper surface of the cushioning layer and the material forming the cushioning layer at least partially enters the apertures of the top layer. Preferably, the formulation of the top layer of thermoplastic material can be varied to alter its coefficient of friction or degree of slip-resistance depending upon the requirements of a particular application. The cushioning material forming the second layer is resilient, and may be moisture-absorbent to help channel away moisture from the top layer of the sheet material.

In one aspect of this invention, the sheet material herein provides a thermal barrier between the foot and surface upon which the sheet material is placed while channeling moisture away from the foot. In one presently preferred embodiment, the top layer of the sheet material is embedded in the cushioning layer so that the upper surface of the top layer is spaced above the upper surface of the bottom layer, and the material forming the cushioning layer extends only partially into the apertures formed in the top layer. A space is thus provided between the upper surface of the top layer and the upper surface of the cushioning layer forming a space therebetween to channel away moisture so that the top layer, which contacts the foot, is maintained relatively dry. Additionally, this space between the upper surface of the top layer and the upper surface of the bottom layer provides an insulative air gap or thermal barrier which resists the transfer of heat or cold between the foot and the surface on which the sheet material rests. The material forming the top layer is also thermally non-conductive which further enhances the sheet material's ability to insulate the foot from heat or cold.

It is contemplated that the sheet material herein would be formed with a relatively large gap or space between the upper surfaces of the top layer and cushioning layer in applications such as welcome mats or other floor coverings in which comfort is not a particular consideration, i.e., where it is likely that one would be wearing a shoe when walking on such material. In these applications, the cushioning material would typically be rubber or a similar substantially non-absorbent, resilient material. Moisture falling on the sheet material would pass through the apertures in the top layer of thermoplastic material onto the non-absorbent cushioning layer and be channeled away along the relatively large space between the upper surface of the top layer and upper surface of the cushioning layer. Additionally, it is contemplated that the top layer of this sheet material would be formed of a thermoplastic material having a high slip-resistance, i.e., a high coefficient of friction.

In an alternative embodiment, the sheet material of this invention is modified to accommodate applications wherein comfort is more of a consideration. For example, in forming insoles for shoes, or floor coverings which are likely to be walked on with bare feet or socks, the sheet material herein is preferably formed with a top layer of thermoplastic material and a second layer of cushioning material preferably with at least some moisture-absorbent properties. In this embodiment, the top, thermoplastic layer of the sheet material is embedded in the second, cushioning layer so that the upper surface of the top layer is spaced a limited distance above or substantially flush with the upper surface of the cushioning layer.

As the foot contacts the sheet material of this embodiment, the apertured top layer is pressed into the cushioning layer to some extent so that the foot contacts both the thermoplastic walls of the top layer between the apertures and the resilient material of the cushioning layer which extends into the apertures of the top layer. Because the foot maintains contact with the thermoplastic walls of the top layer, the slip-resistance of the sheet material is retained but the resilient material of the cushioning layer adds comfort and improved feel to the foot in contact with the sheet material. The cushioning material also absorbs moisture to at least some extent and is effective to wick away at least some moisture from the top layer to help keep it relatively dry and less slippery.

In a still further embodiment of the sheet material herein, a third layer is attached to the second, cushioning layer to form a three-layer sheet material. In this embodiment, the apertured, thermoplastic material forms the top layer, the second, cushioning layer forms a middle layer and the third layer forms a bottom layer. Preferably, the middle layer of this sheet material is formed of a relatively thin section of cushioning material such as latex foam which is both moisture-absorbent and exhibits good cushioning properties. The bottom layer is formed of a cushioning material such as urethane, polyvinylchloride foam, latex foam or the like, or, alternatively, a thin cloth backing with limited resilient properties. In either embodiment, the middle layer of latex foam is effective to at least partially wick moisture away from the top layer leaving it substantially dry so that the slip-resistance of the sheet material is maintained. The bottom layer helps to retain the integrity of the three-layer sheet material, protects the middle layer of latex foam from damage, and, in one embodiment, adds further cushioning to the sheet material.

In another aspect of this invention, the sheet material in any one of the forms described above preferably exhibits a slip-resistance which can be made higher or lower depending upon the requirements of a particular application. The top layer of the sheet material of this invention is a non-absorbent, thermally non-conductive thermoplastic material, and preferably an ethylene-vinyl acetate copolymer sold commercially by U.S. Industrial Chemicals of Tuscola, Ill. under the registered trademark ULTRATHENE. It has been found that by varying the vinyl acetate content of the ULTRATHENE material, the coefficient of friction of the top layer of the sheet material herein can be varied. Depending upon the type of activity for which the sheet material is intended, top layers of the sheet material herein having a different vinyl acetate content can be employed to obtain the desired slip-resistance of the sheet material.

One application of the sheet material herein where the slip-resistance of the top layer is particularly important is the formation of insoles for shoes. For example, in activities such as the play of tennis on clay courts or soccer on grass, the shoe readily slides with respect to the playing surface. In these activities, it is desirable to limit the movement of the foot and sock relative to the insole in the shoe for added comfort and to provide the player with an improved feeling of control of the shoe. Limited movement of the foot and sock relative to the insole is achieved in this invention by forming the top layer of the sheet material herein with a thermoplastic material such as ULTRATHENE UE 646 having a vinyl acetate content of approximately 28% by weight. The upper surface of the top layer of the sheet material formed with ULTRATHENE UE 646 has a somewhat higher coefficient of friction than that of the skin of the foot. This limits the motion of the sock and foot relative to an insole formed of such sheet material and thus provides the desired comfort and "feel" in shoes intended for such activities.

On the other hand, activities such as basketball, racquetball, squash, aerobics exercises and the like are typically played on surfaces such as lacquered hardwood floors which permit little or no movement of the shoe with respect to such surface. In these types of activities, it is preferable to permit at least some movement of both the foot and sock relative to the insole within the shoe to avoid the formation of blisters on the foot. The foot and sock should be permitted to move as a unit relative to the insole for these types of activities, at least to a limited degree, rather than holding the sock in a fixed position atop the insole which allows the foot to move within the sock and cause blisters.

Shoes intended for playing basketball, racquetball and the like are fitted with an insole formed from sheet material of this invention wherein the upper surface of the top layer has a coefficient of friction somewhat less than the coefficient of friction of the skin of the foot. In particular, ULTRATHENE UE 635 having a vinyl acetate content of approximately 9% has been employed in the formation of the top layer which provides a lesser coefficient of friction than that of the skin of the foot and allows the sock and foot to move together as a unit, at least to a limited extent, atop the insole.

Still other activities do not involve substantial sliding of the shoe with respect to the playing surface, or the abrupt starting and stopping movement which accompanies the play of basketball and the like on surfaces having a high coefficient of friction. For example, in activities such as hiking, climbing, walking and jogging, it is desirable to restrict the motion of the foot and sock within the shoe to some degree, but permit at least some sliding motion therebetween. For these applications, the top layer of the insole formed from the sheet material of this invention has a coefficient of friction which is approximately equal to that of the skin of the foot. In other words, the frictional engagement between the sock of the wearer and the insole is approximately equal to the frictional engagement between the sock and the foot of the wearer. This is achieved in the sheet material herein by forming the top layer with a material such as ULTRATHENE UE 652 having a vinyl acetate content of approximately 19% by weight, and a coefficient of friction approximating that of the skin.

It is contemplated that in most other uses of the sheet material herein, the top layer would preferably be formed of a non-absorbent, thermally non-conductive thermoplastic material such as ULTRATHENE UE 646 or a similar material having a relatively high coefficient of friction. For example, in applications such as a covering for the decks of swimming pools, the floors of boats, outdoor carpeting, floor mats and the like, it is believed that a relatively "tacky" or highly slip-resistant surface should be provided by the top layer of the sheet material herein to avoid slippage of the foot, particularly in the presence of moisture. Additionally, the multi-layered sheet material of this invention having at least a second, moisture-absorbent cushioning layer and, in some embodiments, a third layer of cushioning material, provides a measure of shock absorption in the event of a fall on such sheet material.

In another aspect of this invention, the sheet material of this invention is preferably formed in a process wherein a foam material such as latex, polyvinylchloride, urethane, etc. is deposited in flowable form in a layer onto a moving conveyor. A sheet of apertured, thermoplastic material is then passed through feed rollers and laid atop the foam material on the moving conveyor. The viscosity of the foam material is such that the apertured, thermoplastic sheet or layer "sinks into" the foam material and becomes at least partially embedded therein so that the upper surface of the thermoplastic material extends above or flush with the upper surface of the foam layer and the foam material at least partially extends into the apertures of the thermoplastic layer. The thermoplastic layer and foam material layer are then conveyed into an oven for curing wherein the thermoplastic layer is permanently embedded in place within the foam layer to form a continuous sheet.

Depending upon the requirements of a particular application, and the type of foam material combined with the top layer of thermoplastic material, other operations may be performed on the sheet material to form the finished product. For example, in the fabrication of insoles for shoes, a two-layer form of the sheet material herein may be cut into flat insoles or formed by a mold in a contoured, insole shape. In the latter case, a third layer such as urethane may be bonded to the foam layer of the two-layer sheet material during the molding process to form a three-layer insole having a top layer of thermoplastic material, a middle layer of cushioning material such as latex foam, and a bottom layer of urethane or other resilient material.

In an alternative embodiment, a third layer may be added in the sheet material of this invention during the initial molding process. In this embodiment, a bottom layer or backing sheet formed of cloth material or the like is placed on a conveyor and foam material in flowable form is then deposited atop the backing sheet. The top layer of thermoplastic material is then fed onto the foam layer, as described above, after which time all three layers are conveyed into an oven for curing. This procedure produces a three-layer sheet material which is useful, for example, in the formation of floor mats, outdoor carpeting and similar products.

DESCRIPTION OF THE DRAWINGS

The structure, operation and advantages of the presently preferred embodiment of this invention will become further apparent upon consideration of the following description taken in conjunction with the accompanying drawings, wherein.

DETAILED DESCRIPTION OF THE INVENTION

Figure 1:
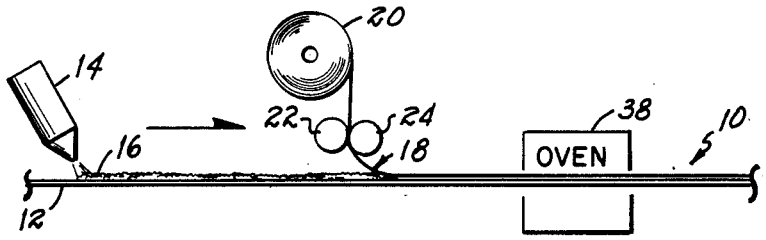
FIG. 1 is a schematic view of one method of forming the sheet material of this invention.
Figure 2:
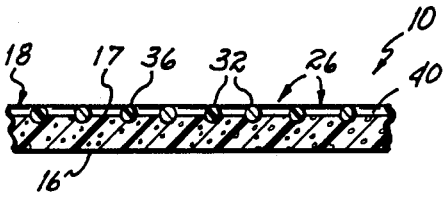
FIG. 2 is a cross sectional view of the sheet material formed by the process illustrated in FIG. 1.
Figure 2A:
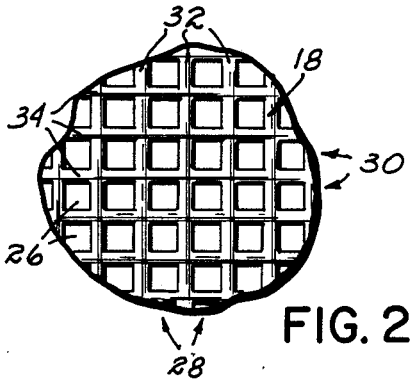
FIG. 2A is a plan view of the apertured, top layer of the sheet material in FIG. 2.
Figure 3:
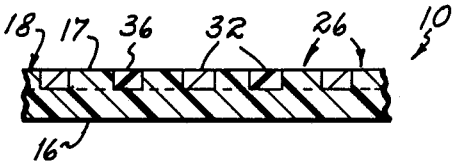
FIG. 3 is a view similar to FIG. 2 of an alternative embodiment of the sheet material herein employing a top layer with a different cross section.

Referring now to FIGS. 1–3, a schematic view is illustrated of one method for forming the multilayered, sheet material 10 of this invention. A conveyor 12 is movable beneath a dispenser 14 which is effective to introduce a cushioning layer 16 of foam material onto the conveyor 12. In the presently preferred embodiment, the foam material forming cushioning layer 16 has the consistency of whipped cream or shaving cream and a variety of foam materials may be utilized including latex, polyvinylchloride, crosslinked polyethylene, cellular urethane and others.

A top layer 18 formed of a non-absorbent, thermally non-conductive sheet of thermoplastic material is fed from a roll 20 through feed rollers 22, 24 onto the upper surface of the bottom layer 16. As viewed in FIGS. 2–3, the top layer 18 is formed with a plurality of spaced apertures 26 arranged in intersecting columns 28 and rows 30. In turn, the apertures 26 define spaced beads or wall sections 32 of thermoplastic material between adjacent columns 28, and spaced beads or wall sections 34 of thermoplastic material between adjacent rows 30.

In one presently preferred embodiment, the apertures 26 in the top layer 18 are substantially square in cross section, although it is contemplated that other shapes could be utilized such as triangular, octagonal, hexagonal and the like. In most applications, the top layer 18 is formed with a number of apertures 26 in the range of about 50 to 700 per square inch. This range is not intended to be restrictive of the aperture size in the top layer 18, but it has been found that such aperture sizes are within the capability of current extrusion equipment which is used to form the top layer 18.

The thickness of the wall sections 32 and 34 of thermoplastic material, i.e., their largest transverse dimension in a vertical plane as viewed in FIGS. 2 and 3–5, is dependent upon the application for the sheet material 10 herein. In the manufacture of insoles for shoes, for example, the thickness of the wall sections 32, 34 is about 0.015 to 0.150 inches. It is contemplated, however, that the thickness of wall sections 32, 34 could be increased as desired for improved wear properties and resistance to tearing, etc. for such other applications as floor coverings and the like, and the above range of wall thickness is not intended to be restrictive. In the embodiment shown in FIGS. 2, 4 and 5, the wall sections 32, 34 are cylindrical in cross section and each have an uppermost surface 36 which is formed in an arcuate shape. Alternatively, the wall sections 32, 34 of top layer 18 can be formed in a generally square or rectangular shape with a substantially planar or flat top surface 36. See FIG. 3.

When the top layer 18 of thermoplastic material is placed onto the upper surface of the bottom layer 16 of foam material, the top layer 18 becomes at least partially embedded in the bottom layer 16. As mentioned above, the foam material forming the bottom layer 16 has a consistency or viscosity similar to that of whipped cream on the conveyor 12 and the weight of the thermoplastic material forming the top layer 18 is sufficient to at least partially sink or embed it into the bottom layer 16. The combined top layer 18 and bottom layer 16 are then moved by the conveyor 12 into an oven 38 which cures the foam and permanently embeds the top layer into the bottom layer 16 to form the sheet material 10.

As viewed in FIG. 2, the top layer 18 is embedded into the foam bottom layer 16 such that the top surface 36 of the wall sections 32, 34 of top layer 18 are located above the uppermost surface 17 of bottom layer 16 forming a space 40 therebetween. Alternatively, as shown in FIG. 3, the uppermost or top surface 36 of wall sections 32, 34 extend substantially flush with the uppermost surface 17 of the bottom layer 16. In either of these embodiments, the top layer 18 is embedded in the bottom layer 16 such that a portion of the cushioning, foam material forming the bottom layer 16 extends at least partially into the apertures 26 of the top layer 18.

The extent to which the top layer 18 is embedded in the bottom layer 16 is chosen to accommodate a particular application for sheet material 10 and is controlled by the viscosity of the foam material forming the bottom layer 16 as well as the amount of time the top layer 18 is allowed to rest upon the bottom layer 16 before they are conveyed into the oven 38 for curing. It is contemplated that in applications wherein a relatively large thermal barrier is required between the top layer 18 and bottom layer 16, and/or where a substantial amount of moisture must be channeled away from the top layer 18, a relatively large space 40 would be provided between the uppermost surface 36 of the wall sections 32, 34 forming the top layer 18 and the uppermost surface 17 of the bottom layer 16. In such applications, the top layer 18 is only partially embedded in the bottom layer 16, e.g., approximately one-quarter to one-half of the thickness of the wall sections 32, 34 extend into the bottom layer 16. This provides a relatively large space 40 between the top surface 36 of wall sections 32, 34 and the bottom layer 16.

One advantage of a relatively large space 40 is that a significant thermal barrier is provided between the top layer 18 and bottom layer 16 which, in turn, insulates the foot or other object placed on top layer 18 from the heat or cold of the surface on which the sheet material 10 is placed. In addition, it is contemplated that in many applications the bottom layer 16 would be formed of a material such as rubber with limited moisture-absorbent properties so that moisture can readily flow along the relatively large space 40 between the top and bottom layers 18, 16, without being absorbed by the bottom layer 16, and thus permit the uppermost surface 36 of the top layer 18 to remain substantially dry.

The embodiment illustrated in FIG. 3, on the other hand, is particularly adapted for applications in which comfort is of primary concern. For example, in applications where the sheet material 10 would touch a bare foot or sock, the wall sections 32, 34 of the top layer 18 are preferably made flush or a limited distance above the uppermost surface 17 of the bottom layer 16. The cushioning material forming the bottom layer 16 therefore extends along a substantial portion of the thickness of the wall sections 32, 34 within the apertures 26 therebetween. When weight is applied to sheet material 10 of this type, such as by stepping on it, the foot comes into contact not only with the wall sections 32, 34 of the top layer 18, but also with the cushioning material of the bottom layer 16 extending into the apertures 26 of top layer 18. Slip-resistance is maintained by virtue of contact with the top layer 18, but the contact with the cushioning material of the bottom layer 16 adds comfort.

Figure 4:
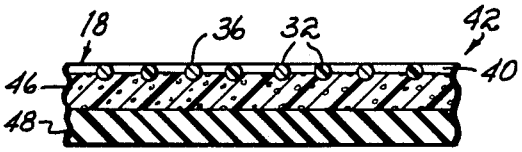
FIG. 4 is a cross sectional view of an alternative embodiment of the sheet material of this invention including a bottom, cushioning layer.
Figure 5:
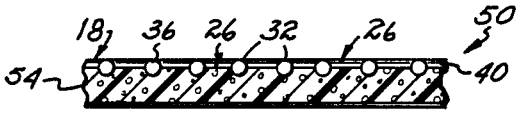
FIG. 5 is a view similar to FIG. 4 except the bottom layer is formed of cloth material.

Referring now to FIGS. 4 and 5, alternative embodiments of the sheet material of this invention are illustrated. In FIG. 4, a sheet material 42 is shown which comprises a top layer 18 embedded in a middle layer 46, and a bottom layer 48 affixed to the middle layer 46. The top layer 18 is embedded into the middle layer 46 in the same manner as with cushioning layer 16 in FIGS. 2 and 3. Preferably, the middle layer 46 is formed of a foam material having both cushioning and moisture-absorbent properties such as latex foam.

In the embodiment shown in FIG. 4, the bottom layer 48 is formed of a cushioning material such as rubber, urethane, crosslinked polyethylene foam or a similar highly resilient material. The bottom layer 48 can be affixed to the middle layer 46 in a variety of ways such as by molding, adhesive bonding and the like. It is contemplated that the sheet material 42 would be particularly useful in the formation of high quality insoles for shoes and similar applications. The middle layer 46 of latex foam is effective to absorb moisture from the foot and sock, and wick it away from the top layer 44 to maintain the foot and sock substantially dry. Additionally, the combined cushioning effect provided by both the middle and bottom layers 46, 48 adds substantial comfort to an insole made of sheet material 42.

In the embodiment of FIG. 5, a three-layer sheet material 50 is formed comprising a top layer 18, a middle layer 54 and a bottom layer 56. In this embodiment, the top layer 18 is embedded into the middle layer 54 in the same manner as described above. The middle layer 54 is preferably formed of a cushioning material of essentially any type, e.g., latex foam, polyvinylchloride foam, urethane foam, rubber, etc. The bottom layer 56 is a sheet of cloth or other fabric material which is molded, adhered or similarly attached to the middle layer 54. The bottom layer 56 helps hold the sheet material 50 together and protects the middle layer 54 from damage. It is contemplated that sheet material 50 of this type would be most useful in applications such as floor coverings and the like.

Figure 6:
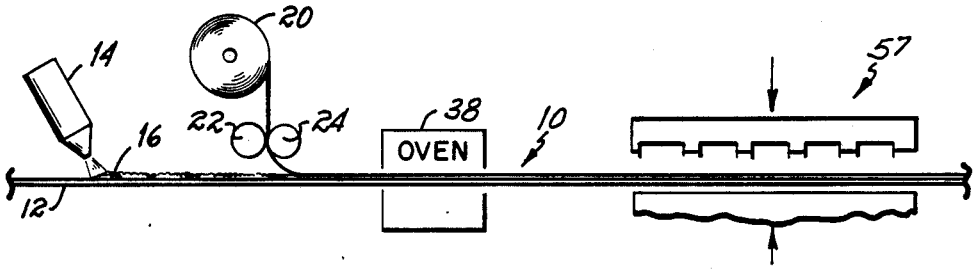
FIG. 6 is a schematic view of one method of forming an insole from the sheet material of this invention.
Figure 7:
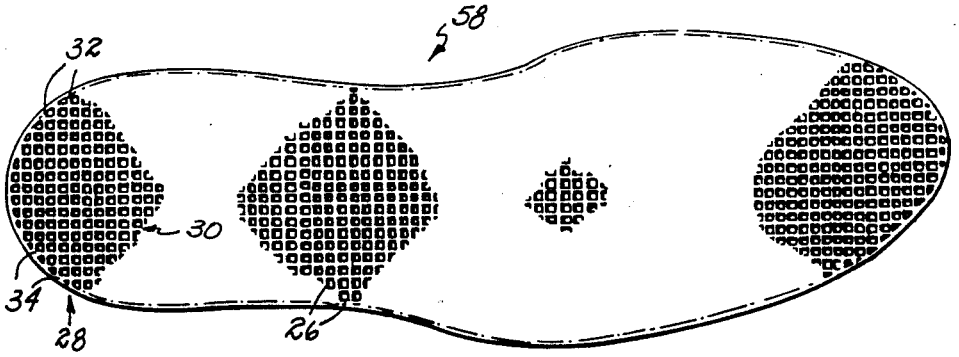
FIG. 7 is a plan view of an insole formed in the process of FIG. 6.
Figure 8:
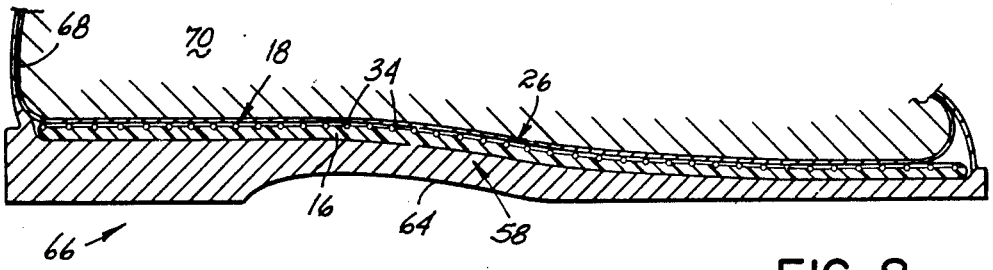
FIG. 8 is a partial cross sectional view of a shoe having an insole formed of the sheet material shown in FIGS. 2 and 3.
Figure 9:
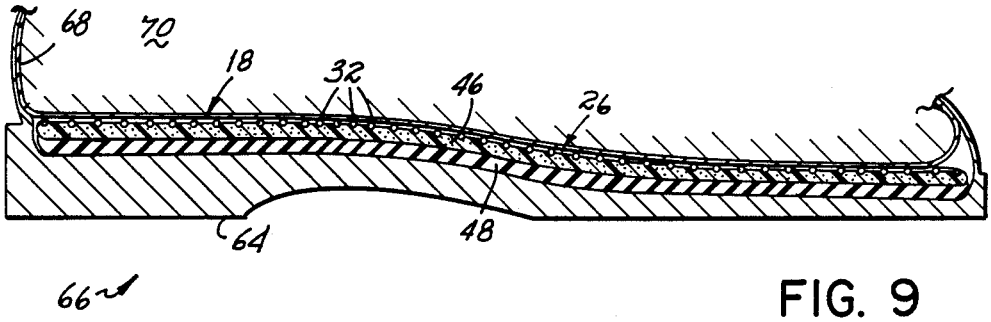
FIG. 9 is a partial cross sectional view of a shoe having an insole formed of the sheet material shown in FIG. 4.

Referring now to FIGS. 6–8, one application for the sheet material of this invention is in the formation of an insole for a shoe. In FIG. 6, the identical process illustrated in FIG. 1 is utilized with the additional step of cutting the sheet material 10 with insole cutters or stamps 57 located downstream from the oven 38 to form the sheet material 10 in the shape of an insole 58. See FIG. 7. The finished insole 58 may be formed with any of the constructions of the sheet material illustrated in FIGS. 2–5. For example, the insole 58 may comprise a top layer 18 formed with apertures 26 defined by wall sections 32, 34 embedded within a cushioning, bottom layer 16 as in the embodiment of sheet material 10 shown in FIGS. 2 and 8. Alternatively, the insole 58 may be formed of the sheet material 42 of FIG. 4 including a top layer 18 embedded within a cushioning layer 46, with a third, cushioning layer 48 affixed to the middle, cushioning layer 46. See FIG. 9. In both of the embodiments illustrated in FIGS. 8 and 9, the insole 58 is adapted to be positioned atop the sole 64 of a shoe 66 to support the sock 68 and foot 70 of the wearer.

One aspect of this invention which is particularly important in the formation of the sheet material 10 or 42 for insoles 58 is the frictional characteristics of the top layer 18 formed by the intersecting wall sections 32 and 34 of thermoplastic material. In the presently preferred embodiment, the top layer 18 of any form of the sheet material 10, 42 or 50 of this invention is formed of an ethylene vinyl acetate copolymer, commercially available from U.S. Industrial Chemicals Company of Tuscola, Ill. under the registered trademark ULTRATHENE. Depending upon the type of activity and playing surface for which a particular shoe 66 is intended, the vinyl acetate content of the top layer 18 of insoles 58 can be varied to alter the coefficient of friction of its uppermost surface which contacts the sock 68. In any application of the sheet material of this invention, the top layer of non-absorbent, thermally non-conductive material exhibits a slip-resistance to the foot or any other object placed thereon. The amount or degree of slip-resistance can be varied with the thermoplastic material employed herein and this feature is particularly important in the design of insoles 58.

For example, in activities played on surfaces which permit substantial movement of the shoe 66 with respect to a playing surface, such as playing tennis on a clay court or soccer on grass, it is preferable to limit the movement of the foot 70 and sock 68 along the top layer 18 of insole 58. In this instance, the coefficient of friction of the uppermost surface of the top layer 18 should be somewhat greater than the coefficient of friction of the skin of the foot in order to provide the desired comfort and "feel" of the shoe. This is achieved in the instant invention by forming the top layer 18 of the sheet material 10 or 42 with a material such as ULTRATHENE UE 646 wherein the vinyl acetate content of the material is approximately 28% by weight. This forms a top layer 18 of the insole 58 whose uppermost surface has a higher coefficient of friction than that of the skin of the foot. The sock 68 and foot 70 are thus prevented from moving to a great degree with respect to the insole 58 which adds to the comfort and performance of shoes 66 intended for such activities.

On the other hand, some types of shoes are intended for activities played on surfaces having a relatively high coefficient of friction such as the play of basketball, racquetball, squash and the like on lacquered hardwood floors. In these activities, the shoe aggressively grips the playing surface and there is a substantial amount of quick and often violent motion of the foot toward the front, back and sides of the shoe. These activities require that the foot 70 and sock 68 be permitted to move at least to some degree with respect to the insole 58 to avoid forming blisters on the foot. This movement is obtained with the insole 58 herein by forming the top layer 18 of sheet material 10 or 42 of a material having a somewhat lower coefficient of friction than that of the skin of the foot, such as ULTRATHENE UE 635. This material has a vinyl acetate content of approximately 9% by weight. The insole 58 formed with such sheet material 10 or 42 has a top layer 18 with an uppermost surface having a somewhat lower coefficient of friction than that of the skin of the foot.

Still other activities do not involve substantial sliding of the foot relative to a surface or violent stopping or starting motions. In activities such as walking, hiking, jogging, etc., it is preferable to form the top layer 18 of insole 58 with a coefficient of friction which permits the foot 70 and sock 68 to move to a greater extent atop the insole 58 than is required where the shoes readily slide on the playing surface, but less than that required for the play of sports such as basketball on hardwood floors. In these applications, the top layer 18 of the sheet material 10 or 42 which forms the insole 58 has an uppermost surface having a coefficient of friction approximately equal to that of the skin of the foot. This has been found to avoid problems of blistering of the foot which can be created where the sock 68 is gripped too tightly within the shoe, and also problems of injury to the toes caused by impact of the foot with the front of the shoe where the sock and foot are allowed to readily slip relative to the insole. In order to provide such a coefficient of friction, the top layer 18 of the sheet material 10 or 42 is preferably formed of a material such as ULTRATHENE UE 652 having a vinyl acetate content of approximately 19% by weight.

It is contemplated that the sheet material 10, 42 or 50 illustrated in FIGS. 2–5 and discussed above, which is intended for applications such as floor coverings and the like, each include a top layer of thermoplastic material having relatively high slip-resistance. Accordingly, a material such as ULTRATHENE UE 646 might be employed to obtain a top layer having a relatively high coefficient of friction. Nevertheless, the frictional characteristics of such top layer may be varied, as described above, where the circumstances of a particular application require a certain coefficient of friction.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the relative spacing of the apertures 26 formed in the top layer 18 illustrated in the Figs., and their shape, is not critical. It is contemplated that the apertures 26 could be of essentially any configuration, e.g., triangular, hexagonal, octagonal, etc., or an irregular shape with irregular spaces between apertures 26, without departing from the scope of the invention. Additionally, the dimensions of the apertures 26 are not critical although it is contemplated that there should be at least about ten apertures 26 per square inch of surface area of the top layer 18 of sheet material 10, 42 or 50 and preferably about 50 to 700 apertures per square inch.

In addition, the thermoplastic material identified above which is used in forming the top layer 18 of sheet material 10, 42 and 50, is an ethylene vinyl acetate copolymer commercially available from U.S. Industrial Chemicals Company of Tuscola, Ill. under the registered trademark ULTRATHENE. This particular material has been found suitable because it is non-absorbent, thermally non-conductive and can be produced in different formulations which exhibit different slip-resistance. It is contemplated, however, that one or more other types of thermoplastic materials could be employed in forming such top layers having generally the same properties as the ULTRATHENE material. In particular, other thermoplastic materials capable of being extruded or otherwise formed with about 50 to 700 apertures per square inch, and exhibiting non-absorbent, thermally non-conductive and slip-resistant properties, are considered within the scope of this invention.

The configuration of the thermoplastic material wall sections 32 and 34 forming top layer 18 are shown as being either cylindrical, rectangular or square in shape in the Figs. In FIG. 2, for example, cylindrical-shaped wall sections 32 are illustrated which are partially embedded within the bottom layer 16 of cushioning material. In FIG. 3, rectangular-shaped wall sections 32 are illustrated whose upper surface is flush with the upper surface 17 of the bottom layer 16. It is contemplated that the extent to which these top layers are embedded in the bottom layers could be reversed, i.e., the uppermost surface of the top layer 18, regardless of whether its wall sections 32, 34 are cylindrical or rectangular, could be either spaced above or flush with the uppermost surface 17 of bottom layer 16. Additionally, the thermoplastic material wall sections 32, 34 could have a different cross section than cylindrical or rectangular and be considered within the scope of this invention.

With respect to the frictional characteristics of the sheet materials 10, 42, 50, the material forming the top layer 18 has been identified as one factor which affects the slip-resistance of such materials 10, 42, 50. In addition, it has been found that the number of apertures 26 formed in the top layer 18 also affects the slip-resistance of sheet materials 10, 42, 50. As the number of apertures 26 per square inch of the top layer 18 increases, the number of wall sections 32, 34 increases thus providing a greater total surface area to contact the foot which increases the slip-resistance of sheet materials 10, 42 and 50. On the other hand, the number of wall sections 32, 34 decreases as the aperture 26 size increases and thus the slip-resistance of the sheet materials 10, 42 and 50 decreases.

Therefore, it is intended that the invention not be limited to the particular embodiment disclosed as the best mode contemplated for carrying out this invention, but that the invention will include all embodiments falling within the scope of the appended claims.

I claim:

1. A sheet material, comprising:

a slip-resistant, non-absorbent and thermally nonconductive first layer formed with a plurality of apertures, said first layer having a first surface;

a second layer having cushioning properties and being moisture-absorbent and air pervious, said second layer having a second surface;

said slip-resistant first layer being at least partially embedded in said second layer so that said first surface of said slip-resistant first layer extends beneath said second surface of said second layer and a portion of said second layer extends at least partially into said apertures in said slip-resistant first layer;

whereby upon contact of moisture with said slip-resistant first layer, said second layer is effective to absorb and wick away the moisture from said first layer so that the slip-resistance of said first layer is substantially maintained in the presence of moisture.

2. The sheet material of claim 1 in which said slip-resistant first layer is formed of an ethylene-vinyl acetate copolymer having a vinyl acetate content of about 9% by weight, said slip-resistant first layer having a coefficient of friction which is less than that of skin.

3. The sheet material of claim 1 in which said slip-resistant first layer is formed of an ethylene-vinyl acetate copolymer having a vinyl acetate content of about 19% by weight, said slip-resistant first layer having a coefficient of friction which is approximately equal to that of skin.

4. The sheet material of claim 1 in which said slip-resistant first layer is formed of an ethylene-vinyl acetate copolymer having a vinyl acetate content of about 28% by weight, said slip-resistant first layer having a coefficient of friction which is greater than that of skin.

5. The sheet material of claim 1 in which said slip-resistant first layer is formed of a thermoplastic material having a coefficient of friction which is less than that of skin.

6. The sheet material of claim 1 in which said slip-resistant first layer is formed of a thermoplastic material having a coefficient of friction which is approximately equal to that of skin.

7. The sheet material of claim 1 in which said slip-resistant first layer is formed of a thermoplastic material having a coefficient of friction which is greater than that of skin.

8. The sheet material of claim 1 in which said second layer is formed of foam material.

9. The sheet material of claim 1 in which a portion of said second layer extends into said apertures of said slip-resistant first layer and flush with said first surface thereof.

10. The sheet material of claim 1 in which said slip-resistant, first layer has in the range of about 50 to 700 apertures per square inch of surface area.

11. The sheet material of claim 1 in which said slip-resistant, first layer has at least about 10 apertures per square inch of surface area.

12. The sheet material of claim 1 in which said slip-resistant, first layer is formed with a plurality of spaced, parallel first wall sections and a plurality of spaced, parallel second wall sections which are perpendicular to and intersect said first wall sections forming said apertures therebetween.

13. The sheet material of claim 12 in which said first and second wall sections are each square in cross section.

14. A sheet material, comprising:

a slip-resistant, non-absorbent and thermally non-conductive top layer formed with a plurality of apertures, said slip-resistant top layer having an upper surface and a lower surface;

a middle layer having cushioning properties and being moisture-absorbent and air pervious, said middle layer having an upper surface and a lower surface;

said slip-resistant, top layer being at least partially embedded in said middle layer so that said lower surface of said slip-resistant, top layer extends beneath said upper surface of said middle layer and a portion of said middle layer extends at least partially into said apertures of said slip-resistant top layer;

a bottom layer fixedly attached to said lower surface of said middle layer;

whereby, upon contact of moisture with said slip-resistant top layer, said middle layer is effective to absorb and wick away the moisture from said top layer so that the slip-resistance of said top layer is substantially maintained in the presence of moisture.

15. The sheet material of claim 14 in which said slip-resistant, top layer has in the range of about 50 to 700 apertures per square inch of surface area.

16. The sheet material of claim 14 in which said slip-resistant, top layer is formed with a plurality of spaced, parallel first wall sections and a plurality of spaced, parallel second wall sections which are perpendicular to and intersect said first wall sections forming said apertures therebetween.

17. The sheet material of claim 16 in which said first and second wall sections are each square in cross section.

18. The sheet material of claim 14 in which said slip-resistant top layer is formed of an ethylene-vinyl acetate copolymer having a vinyl acetate content of about 9% by weight, said slip-resistant top layer having a coefficient of friction which is less than that of skin.

19. The sheet material of claim 14 in which said slip-resistant top layer is formed of an ethylene-vinyl acetate copolymer having a vinyl acetate content of about 19% by weight, said slip-resistant top layer having a coefficient of friction which is approximately equal to that of skin.

20. The sheet material of claim 14 in which said slip-resistant top layer is formed of an ethylene-vinyl acetate copolymer having a vinyl acetate content of about 28% by weight, said slip-resistant top layer having a coefficient of friction which is greater than that of skin.

21. The sheet material of claim 14 in which said slip-resistant top layer is formed of a thermoplastic material having a coefficient of friction which is less than that of skin.

22. The sheet material of claim 14 in which said slip-resistant top layer is formed of a thermoplastic material having a coefficient of friction which is approximately equal to that of skin.

23. The sheet material of claim 14 in which said slip-resistant top layer is formed of a thermoplastic material having a coefficient of friction which is greater than that of skin.

24. The sheet material of claim 14 in which said bottom layer is formed of a material chosen from the group of latex foam, urethane, crosslinked polyethylene foam, rubber, and fabric material.

* * * * *